US008702837B2

(12) United States Patent
Devaux et al.

(10) Patent No.: US 8,702,837 B2
(45) Date of Patent: Apr. 22, 2014

(54) METHOD OF INTEGRATING A BLAST FURNACE WITH AN AIR GAS SEPARATION UNIT

(75) Inventors: Michel Devaux, Roissy-en-Brie (FR); Richard Dubettier-Grenier, La Varenne Saint Hilaire (FR)

(73) Assignee: L'Air Liquide, Societe Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 13/553,740

(22) Filed: Jul. 19, 2012

(65) Prior Publication Data

US 2012/0280436 A1 Nov. 8, 2012

Related U.S. Application Data

(63) Continuation of application No. 12/281,172, filed as application No. PCT/FR2007/050804 on Feb. 15, 2007, now abandoned.

(30) Foreign Application Priority Data

Mar. 3, 2006 (FR) ..... 06 50762

(51) Int. Cl.
*C21B 5/00* (2006.01)

(52) U.S. Cl.
USPC ..... 75/466; 75/458; 266/44

(58) Field of Classification Search
USPC ..... 266/44; 75/458, 466
See application file for complete search history.

(56) References Cited

U.S. PATENT DOCUMENTS

| | | | | |
|---|---|---|---|---|
| 3,143,412 | A * | 8/1964 | Robinson, Jr. et al. | 75/466 |
| 5,244,489 | A | 9/1993 | Grenier | |
| 5,291,737 | A | 3/1994 | Camberlein et al. | |
| 5,317,862 | A | 6/1994 | Rathbone | |
| 6,155,079 | A | 12/2000 | Vigor et al. | |
| 2002/0166323 | A1 * | 11/2002 | Marin et al. | 60/775 |
| 2007/0170624 | A1 * | 7/2007 | Dubettier-Gernier et al. | 266/141 |

FOREIGN PATENT DOCUMENTS

| | | |
|---|---|---|
| EP | 0888805 A2 | 1/1999 |
| FR | 2857028 A1 | 1/2005 |
| JP | 59-212676 A | 12/1984 |

OTHER PUBLICATIONS

Capogrosso L., et al.; "Optimising Oxygen Enrichment to Blast Furnaces Using Coal Injection"; Steel Times International, DMG World Media, Lewis GB, vol. 27, No. 2, Feb. 2003.

Springmann, H., "The planning of Large Oxygen Plants in Steel Works", Linde Reports on Science and Technology, 25/1977, pp. 28-33.

PCT/FR2007/050804; International Search Report; Dated Jul. 27, 2007.

* cited by examiner

*Primary Examiner* — Lois Zheng
(74) *Attorney, Agent, or Firm* — Christopher J. Cronin

(57) ABSTRACT

The invention relates to a method of integrating a plurality of blast furnaces with a plurality of air gas separation units, in which the replacement blower available on the blast furnace site is used to feed compressed air into an air gas separation unit making it possible to enrich the blast-furnace blast with oxygen, this unit being stopped when one of the blowers of the blast furnaces has to be replaced with the blower used by the air gas separation unit.

17 Claims, 1 Drawing Sheet

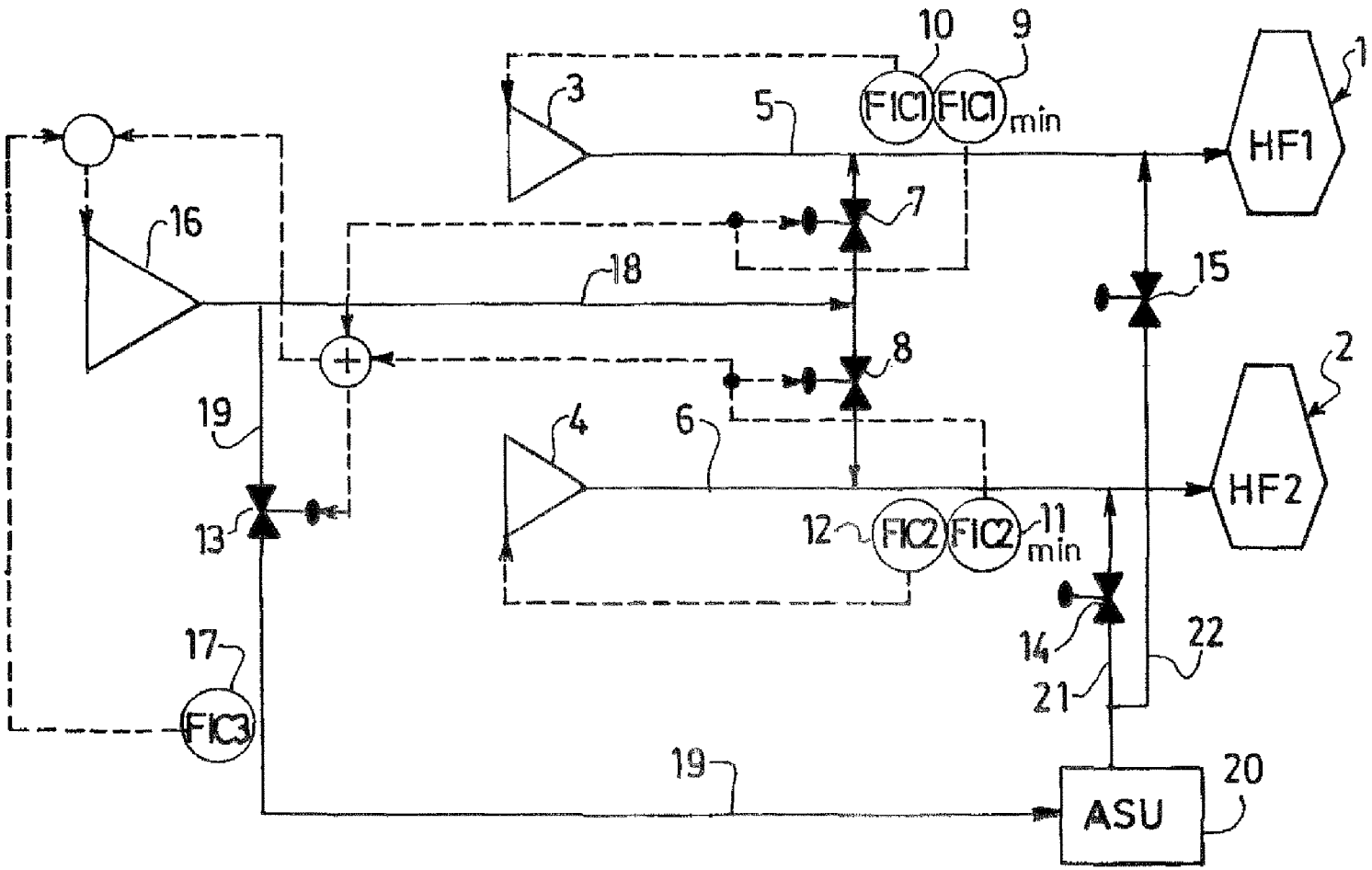
HF1
HF2
ASU
FIC1
FIC2
FIC3
min
min
1
2
3
4
5
6
7
8
9
10
11
12
13
14
15
16
17
18
19
19
20
21
22

METHOD OF INTEGRATING A BLAST FURNACE WITH AN AIR GAS SEPARATION UNIT

This application is a continuation of U.S. patent application Ser. No. 12/281,172, filed Aug. 29, 2008, now abandoned, which is a §371 of International PCT Application PCT/FR2007/050804, filed Feb. 15, 2007.

FIELD OF THE INVENTION

The present invention relates to a method of integrating at least one blast furnace with at least one air gas separation unit, in which method n blast furnaces and at least one air gas separation unit are fed with air by at least n+1 compressors with n≥1 and preferably >1.

BACKGROUND

A blast furnace is the most widely used equipment for producing pig iron, essentially composed of iron (92 to 95% by weight), carbon (3 to 5% by weight) and other elements in small amount, such as silicon, manganese, phosphorus, sulfur, etc.

This pig iron is then converted to steel in an oxygen converter, by injecting oxygen into the pig iron in the liquid state, in particular of oxidizing the carbon.

The steel obtained with then be refined and made to the desired grade (silicon steel, manganese steel, etc.) before being cast into ingots, slabs, blooms or billets.

A blast furnace is essentially fed with iron ore (in general 1.3 to 1.6 tonnes per tonne of pig iron produced) in the form of agglomerates or pellets, introduced via the top of the blast furnace, with coke (between 250 and 500 kg per tonne of pig iron), also introduced via the top, pulverized coal injected into the tuyeres, the injected amount possibly varying between 0 and 250 kg per tonne of pig iron, or with any other fuel, such as natural gas, fuel oil, coking gas, plastics, and with air, also called "wind", with a flow rate that may vary from 800 to 1200 $Sm^3$ per tonne of pig iron produced, the air being enriched with oxygen or not, this enrichment possibly varying from 0 to about 15% by volume, i.e. 0 to 150 $Sm^3$ of oxygen per tonne of pig iron produced.

This blast furnace produces mainly pig iron, slag (200 to 400 kg per tonne of pig iron produced), which slag may then be utilized in various applications, and gases, containing in particular nitrogen (40 to 60% by volume), carbon monoxide CO (20 to 25% by volume), carbon dioxide $CO_2$ (20 to 25% by volume) and hydrogen (1 to 7% by volume).

Various other elements with a content of less than 1% may also be produced.

The gas or gas mixture output by the blast furnace is generally recovered and used for its thermal value, either by direct exchange, in order to lower its temperature and increase that of the gas or fluid with which it is in heat exchange, or by combustion, for example CO with oxygen so as to produce additional heat.

The blast-furnace wind, whether enriched with oxygen or not, is injected at the base of the blast furnace via tuyeres that are distributed all around the circumference of the blast furnace.

This wind is injected under a pressure that may vary from 1 to $7\times10^5$ Pa so as to overcome the pressure drop in the blast furnace and the pressure at the top of the charge in the blast furnace.

The air flow rates required are very high, varying from 5000 $Sm^3$/hour for very small blast furnaces (for example those seen at the present time particularly in China) up to 500 000 $Sm^3$/hour for very large industrial blast furnaces.

To bring the ambient air to this pressure, very powerful air compressors or "blowers" are used, one (or more) blowers being dedicated to one blast furnace.

In a factory producing pig iron and having more than one blast furnace, it is general practice when having n blast furnaces to use at least n+1 blowers and sometimes n+2 blowers, so as to ensure continuous pig iron production when one of these blowers possibly breaks down (or has to be stopped for maintenance or any other reason).

Now, the redundant blowers (also called second blowers) which are redundant relative to the number of blast furnaces, are generally mounted alongside the other blowers in operation and are in a stand-by position, ready to be started so as to ensure continuity of pig iron production, even when an air pressure and/or flow rate on a blower at a predetermined value below which it is necessary to replace this blower with one of the stand-by blowers, is detected.

In general, to enrich the air wind with oxygen, one or more large-capacity oxygen production units, generally cryogenic air separation units producing oxygen of industrial purity, that is to say generally a purity greater than 80 vol %, preferably greater than 90 vol %, more preferably greater than 95 vol % and sometimes of purity greater than 99 vol %, are provided on the pig iron production site close to the blast furnaces or are connected thereto via lines.

The increase in oxygen requirement of a pig iron production site may arise either in the case of an increase in pig iron production in the existing blast furnaces, or by addition of one or more new blast furnaces on the site, or by increase in the specific oxygen consumption in each blast furnace, as a result, for example, of the addition of more fuel, such as coal, natural gas, fuel oil, coking gas, plastics, etc. (this addition generally takes place in the tuyeres). This increase may result from the use of oxygen for another technical objective, such as for example the enrichment of air dedicated for cowper preheating.

In this case, the increase in oxygen requirement may result in the construction of a new oxygen production unit, whether a cryogenic air separation unit or a unit producing oxygen by what are called VPSA processes.

When it is necessary to make such an investment in a new air gas separation unit, taking into account the high cost of such a unit, it may prove necessary or preferable to use components already existing on the site.

The method according to the invention involves this problem thus posed.

SUMMARY OF THE INVENTION

The present invention is characterized in that since each blast furnace is fed by at least one compressor from the at least n+1 compressors available, at least one of the compressors that are not feeding a blast furnace (hereafter called "second compressor") is used to feed the air gas separation unit, whereas, as soon as one of the compressors (hereafter called "first compressor") feeding a blast furnace produces air at a flow rate below a predetermined flow rate $D_{min}$, said first compressor is disconnected from said blast furnace and the second compressor is connected to said blast furnace and preferably disconnected from the air gas separation unit.

BRIEF DESCRIPTION OF THE FIGURE

FIG. 1 illustrates an installation for implementing the method of the present invention.

DETAILED DESCRIPTION OF THE INVENTION

In the present invention, the flow rate $D_{min}$ typically corresponds to the minimum flow rate required for the blast furnace to which it is connected to operate correctly.

In this way, one of the available compressors or blowers (second compressor) is used when the other blowers (first compressors) are in normal operation and are normally feeding their respective blast furnace, in order to feed the air gas separation unit with compressed air (in general in an additional small compressor to increase the pressure of the air delivered to the air gas separation unit up to a value of at least about $5\times10^5$ kPa and/or to supplement the volume of air delivered to the separation unit) and, when a problem in one of the first compressors feeding the blast furnace is detected, the first compressor having a problem is stopped and replaced with the compressor responsible in the meantime for feeding the air gas separation unit with compressed air, this unit being, during this period, on stand-by, until a (another) second compressor becomes available (after the first compressor has been repaired) for feeding the air gas separation unit with compressed air. Preferably, a complementary compressor, dedicated to the air gas separation unit, is provided so as to deliver at least some of the compressed air needed for this unit and/or the necessary overpressure.

In the present context, a compressor is said to be "connected" or "linked" to a blast furnace or to an air gas separation unit when said compressor feeds the blast furnace, or the air gas separation unit respectively, with compressed air. Similarly, a compressor is said to be "disconnected" from a blast furnace or from an air gas separation unit when it is not feeding the blast furnace, or the air gas separation unit respectively, with compressed air.

Depending on the air flow rate needed for the blast furnace and an air gas separation unit, and on the maximum flow rate that the available blower (second compressor) can deliver, it will be possible, in certain circumstances, for the air gas separation unit to continue operating during the stand-by period, but with a reduced flow of compressed air (reduced by the flow needed for the blast furnace to which this blower is now connected).

Various alternative forms of the invention are possible:

One or more blowers present on the site and intended for compressing the air or wind sent to the blast furnace, especially the stand-by blowers, may be used to compress at least some of the air needed for the manufacture of oxygen by one or more air gas separation units.

The characteristics of one or more blowers initially designed to work within operating ranges matched to the specific pressure and flow rate requirements for the blast furnace may be adapted to the specific pressure and flow rate requirements for the oxygen production unit.

The air compressed to a pressure in all cases above 2 bar absolute, produced by one of the blowers initially dedicated to a blast furnace, may be sent to the oxygen production unit or to the blast furnace.

In "normal" operation, that is to say when all the blowers are operating, the air from the stand-by blower (second compressor) will be entirely or only partly sent to the inlet of the air gas separation unit.

In contrast, in an emergency, that is to say when an insufficient number of blowers is operating normally for injecting the wind into the blast furnaces, the air from this additional blower may then be sent again to the blast furnace, the operation of the oxygen production unit being stopped or adapted to down-graded operation compatible with the desired operation of the blast furnaces.

A system of lines for sending the compressed air to one or other of the destinations (blast furnace or air gas separation unit) may be provided.

Preferably, a regulating system will be used to optimize the adaptation, while the operating range of the blower or blowers initially in stand-by position will be designed to allow flexibility in adapting to the various possible situations.

The operation of the air gas separation unit producing oxygen may be completely stopped if pig iron production demand by the blast furnaces so requires and is chosen by the operator as being of higher priority.

Preferably, the air gas separation unit produces oxygen at a purity of greater than 90 vol % (also called impure oxygen) and preferably with an oxygen purity greater than 95 vol %.

Also preferably, a complementary compressor dedicated to the air gas separation unit will be provided so as to deliver some of the air needed for the air gas separation unit (if a large quantity of air, too great for the capacity of one blower, is needed). Furthermore, this supplementary compressor may be used to operate the separation unit when the blower (second compressor) is required by a blast furnace. This supplementary compressor may also be used as replacement blower in the event of two simultaneous breakdowns, in which case the separation unit will be stopped).

The oxygen produced by the air gas separation unit may be intended partly for the blast furnaces or partly for other installations generally present on the site, such as the converters. Thus, some of the oxygen produced by the air gas separation unit is used in at least one of the converters present on the integration site.

According to a variant, the air gas separation unit has two operating modes, namely what is called a "regular" operating mode and what is called a "degraded" operating mode.

Typically, the air gas separation unit operates in regular operating mode when it is fed with air by the second compressor and in degraded operating mode when the second compressor is connected to a blast furnace, i.e. during the stand-by period of the air gas separation unit.

According to a first embodiment, the air gas separation unit produces oxygen with a purity of greater than 90 vol % in regular operating mode and with a purity of 90% or less in degraded operating mode. According to another embodiment, the air gas separation unit produces oxygen with a purity of greater than 95 vol % in regular operating mode and 95% or less in degraded operating mode. The air gas separation unit may also generate a first flow of oxygen in regular operating mode and a second flow of oxygen, less than the first, in degraded operating mode.

Thus, the air gas separation unit may deliver oxygen and in particular feed the compressed-air lines connected to the blast furnace with oxygen, even during the stand-by period.

For a further understanding of the nature and objects for the present invention, reference should be made to the detailed description, taken in conjunction with the accompanying FIGURE, in which like elements are given the same or analogous reference numbers and wherein:

According to another embodiment, the separation unit comprises lines (18, 19) and valves (7, 8, 13) for connecting the second compressor (16) either to at least one of the lines (5, 6) for feeding the blast furnaces with air, or to an air gas separation unit (20), or to both.

The invention will be better understood with the aid of the following exemplary embodiment described in the single FIGURE, which shows an embodiment of the invention using two blast furnaces, one air gas separation unit and three compressors.

The blast furnaces, 1 and 2 respectively, are connected to the compressors 3 and 4, respectively, via the compressed-air feed lines 5 and 6.

On the line 5 there is a flow sensor 9 measuring the minimum flow in the line 5 and a flow sensor 10 regulating the flow of compressed air from the compressor 3.

The same function with the minimum-flow detectors 11 are found on the lines 6 and 12 for regulating the compressor 4.

The compressors 3 and 4 are the blowers normally used to feed their respective blast furnaces.

On the site, there is a supplementary compressor or blower intended to mitigate the failings of the compressor 3 or 4.

This supplementary compressor 16 is connected via the feed line 19 and the valve 13 to the air gas separation unit 20, on the one hand, and via the line 18 to the valves 7 and 8, the latter being connected to the feed lines 5 and 6 respectively.

On the feed line 19 there is a flow sensor 17 responsible for regulating the flow of air sent by the compressor 16 to the air gas separation unit 20 when said compressor is in operation.

The air gas separation unit 20 is connected via the feed lines 21 and 22 respectively to the valves 14 and 15 that feed the lines 6 and 5 respectively.

The operation of this system is as follows: in normal operation, that is to say when the compressors 3 and 4 are operating normally, that is to say that the flow of air sent to the blast furnaces 1 and 2 respectively is above the minimum required for normal operation of these blast furnaces, and measured by the detectors 9 and 11 respectively, the valves 14 and 15, and also the valve 13, are in the open position.

In this case, the replacement compressor 16 feeds, via the open valve 13, the air gas separation unit which itself outputs its oxygen through the respective valves 14 and 15 to the wind feed lines of the blast furnaces 6 and 5 so as to enrich this wind with the desired amount of oxygen.

However, when one and/or other of the two detectors, 9 or 11, detects a flow anomaly in the line 5 or 6, the valve 13 which was open in the line 19 is then closed or partly closed, the detectors 9 and/or 11 simultaneously opening the valves 7 and/or 8 (which are normally closed during the "normal" operating period) so as to be able to feed the lines 5 and/or 6 with compressed air via these valves 7 and 8.

Depending on the choice made by the operator or permitted by the installation, the valves 14 and 15 will either be completely closed (preferred mode) or partly closed if the air gas separation unit 20 can continue to operate in degraded mode.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A method of integrating n(≥1) blast furnaces with at least one air gas separation unit, comprising the steps of:

feeding air with at least n+1 compressors to n blast furnaces and to an air gas separation unit producing oxygen with an oxygen purity of greater than 90 vol %, the air being fed to said air gas separation unit being fed at a pressure of at least about $5\times10^5$ kPa, each of said blast furnaces being fed by at least one compressor from said at least n+1 compressors, at least one of said at least n+1 compressors does not feed a blast furnace but instead is used to feed the air to said gas separation unit;

as soon as one of said at least n+1 compressors that is feeding air to said n blast furnaces is producing air at a flow rate below a predetermined flow rate Dmin, it is disconnected from a respective one of said blast furnaces and the compressor that is feeding air to said gas separation unit is connected to said blast furnace.

2. The method of claim 1, wherein a supplementary compressor delivers compressed air and/or the overpressure to the air gas separation unit.

3. The method of claim 1, wherein the blast furnaces are fed with oxygen by the air gas separation unit.

4. The method of claim 1, wherein at least some of the oxygen produced by the air gas separation unit is used in at least one converter.

5. The method of claim 4, wherein the air gas separation unit produces oxygen with an oxygen purity of greater than 95 vol %.

6. The method of claim 1, wherein the air gas separation unit has two operating modes, namely a regular operating mode producing oxygen with a purity of greater than 90 vol % and a degraded operating mode producing oxygen with a purity of 90 vol % or less.

7. The method of claim 1, wherein the air gas separation unit has two operating modes, namely a regular operating mode producing oxygen with a purity of greater than 95 vol % and a degraded operating mode producing oxygen with a purity of 95 vol % or less.

8. The method of claim 1, wherein the air gas separation unit has two operating modes, namely a regular operating mode producing a first oxygen flow and a degraded operating mode producing an oxygen flow smaller than the first oxygen flow.

9. The method of claim 2, wherein the blast furnaces are fed with oxygen by the air gas separation unit.

10. The method of claim 9, wherein at least some of the oxygen produced by the air gas separation unit is used in at least one converter.

11. The method of claim 10, wherein the air gas separation unit produces oxygen with an oxygen purity of greater than 90 vol %.

12. The method of claim 10, wherein the air gas separation unit produces oxygen with an oxygen purity of greater than 95 vol %.

13. The method of claim 10, wherein the air gas separation unit has two operating modes, namely a regular operating mode producing oxygen with a purity of greater than 90 vol % and a degraded operating mode producing oxygen with a purity of 90 vol % or less.

14. The method of claim 10, wherein the air gas separation unit has two operating modes, namely a regular operating mode producing a first oxygen flow and a degraded operating mode producing an oxygen flow smaller than the first oxygen flow.

15. The method of claim 12, wherein the air gas separation unit has two operating modes, namely a regular operating mode producing a first oxygen flow and a degraded operating mode producing an oxygen flow smaller than the first oxygen flow.

16. The method of claim 13, wherein the air gas separation unit has two operating modes, namely a regular operating mode producing a first oxygen flow and a degraded operating mode producing an oxygen flow smaller than the first oxygen flow.

17. The method of claim 1, wherein the compressor that is connected to the blast furnace, from which one of the compressors is disconnected upon production of air at a flow rate below a predetermined flow rate Dmin, is disconnected from the air gas separation unit.

* * * * *